US010571839B2

(12) United States Patent
Shibahara

(10) Patent No.: US 10,571,839 B2
(45) Date of Patent: Feb. 25, 2020

(54) FIXING DEVICE AND IMAGE FORMING APPARATUS

(71) Applicant: KYOCERA Document Solutions Inc., Osaka (JP)

(72) Inventor: Masami Shibahara, Osaka (JP)

(73) Assignee: KYOCERA Documents Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 16/391,828

(22) Filed: Apr. 23, 2019

(65) Prior Publication Data

US 2019/0332046 A1 Oct. 31, 2019

(30) Foreign Application Priority Data

Apr. 26, 2018 (JP) ..... 2018-085648

(51) Int. Cl.
*G03G 15/20* (2006.01)
*G03G 15/00* (2006.01)

(52) U.S. Cl.
CPC ..... *G03G 15/2064* (2013.01); *G03G 15/2053* (2013.01); *G03G 15/80* (2013.01); *G03G 2215/2035* (2013.01)

(58) Field of Classification Search
CPC ..... G03G 15/2014; G03G 15/2053; G03G 15/2064; G03G 15/80; G03G 21/1685
USPC ..... 399/107, 110, 122, 320, 328, 329
See application file for complete search history.

(56) References Cited

U.S. PATENT DOCUMENTS 8,676,104 B2 * 3/2014 Yoshikawa ..... G03G 15/2053 399/329
2014/0105634 A1 4/2014 Tanaka et al.

FOREIGN PATENT DOCUMENTS

JP 2014-081524 A 5/2014
JP 2014-109754 A 6/2014

* cited by examiner

*Primary Examiner* — Hoan H Tran
(74) *Attorney, Agent, or Firm* — IP Business Solutions, LLC

(57) ABSTRACT

In a fixing device, a pressure roller is in contact with a fixing belt to form a fixing nip part with the fixing belt, a heating member heats the fixing belt when electrodes are energized, and a holding member holds the heating member. A connector in the fixing device includes a contact terminal that is in contact with the electrode, and by being mounted at a predetermined position of the holding member, the electrode and the contact terminal are in contact with each other. The holding member includes: a guide part having an inclined surface which is inclined with respect to a predetermined direction; and a positioning part that sets the position of the connector, inserted while being in contact with the inclined surface, in a rotatable state toward the predetermined position. The contact terminal is in contact with the electrode over a period before and after rotation of the connector.

6 Claims, 12 Drawing Sheets

FIXING DEVICE AND IMAGE FORMING APPARATUS

INCORPORATION BY REFERENCE

This application claims priority to Japanese Patent Application No. 2018-085648 filed on Apr. 26, 2018, the entire contents of which are incorporated by reference herein.

BACKGROUND

The present disclosure relates to a fixing device and an image forming apparatus, and more particularly, to a technique for energizing a heating member using a connector having a contact terminal.

In recent years, there has been a known fixing device of a type in which a fixing belt is heated by a heating member in which a planar heat generating body and an electrode are provided on a ceramic substrate. In such a fixing device, there is a known technique in which the heat generating body is energized by using a connector having the contact terminal that is in contact with the electrode.

For example, a fixing device is disclosed which includes a U-shaped connector having a plurality of current-carrying terminals in contact with a plurality of electrodes provided at the end of a ceramic heater. In such a fixing device, a lock member for fixing the connector is provided in the connector. In addition, a fixing device is disclosed which includes a contact terminal having a U-shaped cross-section having a pair of spring contact parts that are in contact with electrode parts provided on both the front and back sides of a planar heater.

SUMMARY

A technique improved over the aforementioned techniques is proposed as one aspect of the present disclosure.

A fixing device according to one aspect of the present disclosure includes a fixing belt, a pressure roller, a heating member, a holding member, and a connector. The fixing belt is endless. The pressure roller is in contact with the fixing belt to form a fixing nip part with the fixing belt. The heating member includes an electrode and heats the fixing belt when the electrode is energized. The holding member holds the heating member. The connector includes a contact terminal in contact with the electrode and is mounted at a predetermined position of the holding member so that the electrode and the contact terminal are in contact with each other. The holding member includes: a guide part having an inclined surface that is inclined with respect to a predetermined direction; and a positioning part that sets the position of the connector, inserted while being in contact with the inclined surface, in a rotatable state toward the predetermined position. The electrode is configured such that the contact terminal is in contact with the electrode over a period before and after the rotation of the connector.

An image forming apparatus according to one aspect of the present disclosure includes the above described fixing device and an image forming unit. The image forming unit forms a toner image on a recording sheet. At the fixing nip part, the fixing device fixes the toner image formed by the image forming unit to the recording sheet.

DETAILED DESCRIPTION

Figure 1:
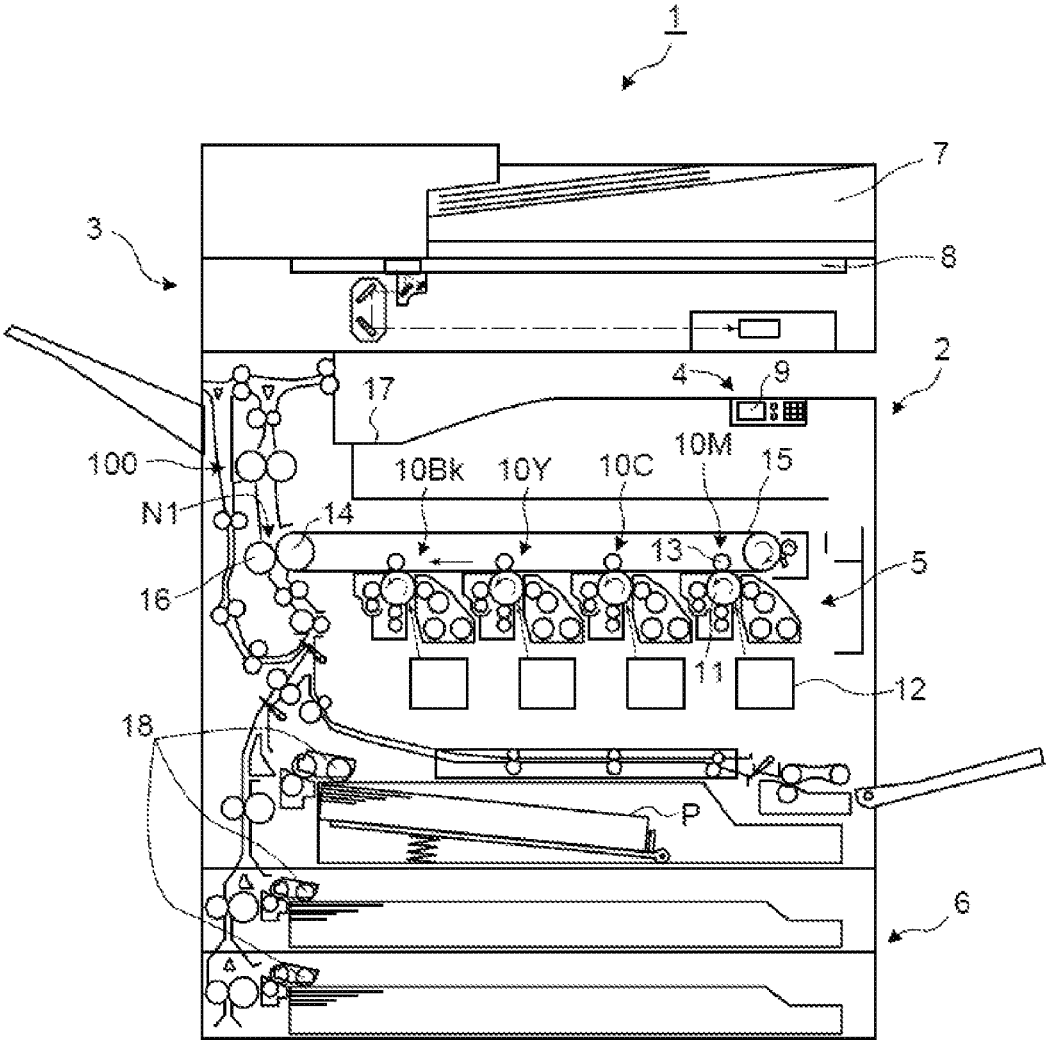
FIG. 1 is a front cross-sectional view showing a configuration of an image forming apparatus provided with a fixing device according to an embodiment of the present disclosure.

A fixing device and an image forming apparatus according to an embodiment as one aspect of the present disclosure are described below with reference to the drawings. FIG. 1 is a front sectional view showing a configuration of an image forming apparatus 1 provided with a fixing device 100 according to an embodiment of the present disclosure.

The image forming apparatus 1 is a multifunction peripheral having a plurality of functions such as a facsimile function, a copy function, a printer function, and a scanner function. The image forming apparatus 1 includes an apparatus main body 2 and an image reading device 3. The apparatus main body 2 includes an operating unit 4, an image forming unit 5, a fixing device 100, a sheet feeding unit 6, and the like.

The image reading device 3 includes a document conveyance unit 7 that conveys a document, and a scanner that optically reads a document conveyed by the document conveyance unit 7 or a document placed on a contact glass 8. The image reading device 3 includes, for example, an ADF (Auto Document Feeder). The image reading device 3 irradiates a document by using a light irradiator and receives the reflected light by using a CCD (Charge-Coupled Device) sensor, thereby reading an image from the document and acquiring image data. The image data acquired by the image reading device 3 is stored in a built-in HDD (not shown) or a personal computer connected via a network.

The operating unit 4 is provided near the image reading device 3 and on the front side of the image forming apparatus 1. The user inputs instructions, and the like, for various functions executable by the image forming apparatus 1 via the operating unit 4. The operating unit 4 includes a touch-panel type display unit 9. The display unit 9 displays various screens regarding various functions executable by the image forming apparatus 1.

The image forming unit 5 forms a toner image on recording paper P supplied from the sheet feeding unit 6 based on the image data acquired by the image reading device 3 or the image data sent from a personal computer connected via a network, other facsimile machines, or the like.

The image forming unit 5 includes image forming units 10M, 10C, 10Y, and 10Bk (hereinafter, there is a case of simply referred to as "image forming unit 10"). The image forming unit 10 includes: a photosensitive drum 11; a toner cartridge that stores toner; a charging device that uniformly charges the surface of the photosensitive drum 11; an exposure device 12 that exposes the surface of the photosensitive drum 11 to form an electrostatic latent image; a developing device that supplies toner to the photosensitive drum 11 to develop an electrostatic latent image into a toner image; and a primary transfer roller 13.

When color printing is performed, each of the image forming unit 10M for magenta, the image forming unit 10C for cyan, the image forming unit 10Y for yellow, and the image forming unit 10Bk for black in the image forming unit 5 forms a toner image on the photosensitive drum 11 by conducting charging, exposing, and developing based on image data composed of each of the color components that constitute image data, and transfers the toner image onto an intermediate transfer belt 15 extending between a drive roller 14 and a driven roller by the primary transfer roller 13.

The intermediate transfer belt 15 has an image bearing surface on the outer circumferential surface to which a toner image is transferred. The intermediate transfer belt 15 is driven to rotate by the drive roller 14 in a state of being in contact with the circumferential surface of each of the photosensitive drums 11. The intermediate transfer belt 15 endlessly travels between the drive roller 14 and the driven roller in synchronization with the rotation of each of the photosensitive drums 11.

The toner images of the respective colors transferred onto the intermediate transfer belt 15 are superimposed on the intermediate transfer belt 15 by adjusting the transfer timing to form a color toner image.

The secondary transfer roller 16 transfers, to the recording paper P conveyed from the sheet feeding unit 6, the color toner image formed on the surface of the intermediate transfer belt 15 at a transfer nip part N1 formed between the secondary transfer roller 16 and the drive roller 14 with the intermediate transfer belt 15 interposed therebetween.

The fixing device 100 fixes the color toner image on the recording paper P to the recording paper P. The recording paper P on which the fixing process has been completed and the color image has been formed is discharged into a discharge tray 17.

The sheet feeding unit 6 includes a plurality of sheet feeding cassettes. When the size of the recording paper P is input by the user via the operating unit 4, a pickup roller 18 of the sheet feeding cassette storing the recording paper P with the input size is rotationally driven, and the recording paper P is transported to the conveyance path.

[The Fixing Device 100]

Figure 2:
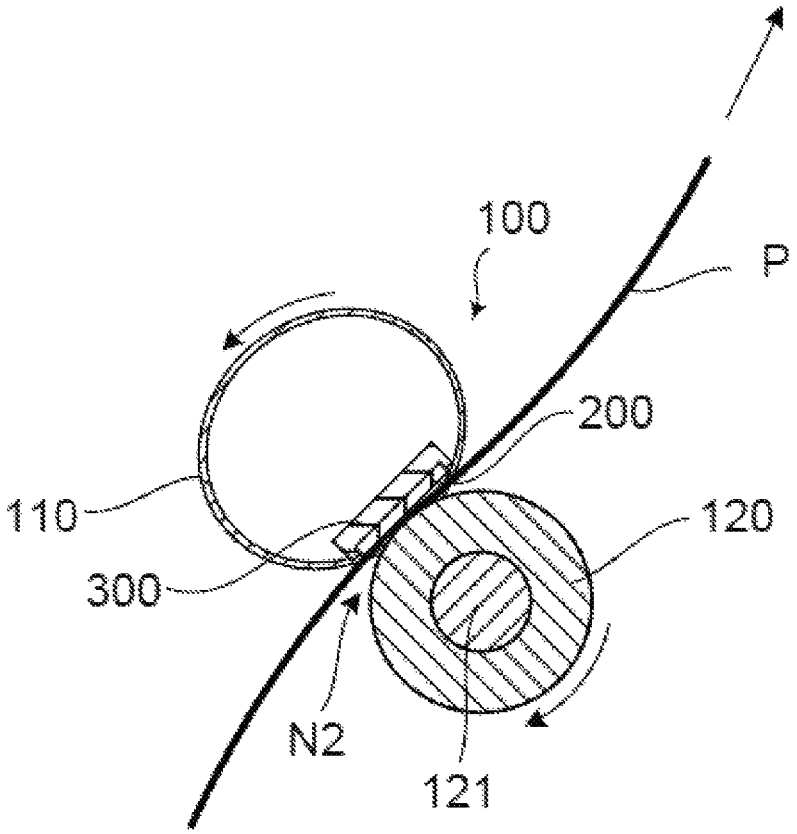
FIG. 2 is a cross-sectional view showing a configuration of the fixing device.

FIG. 2 is a cross-sectional view showing the configuration of the fixing device 100. With reference to FIG. 2, the fixing device 100 includes: an endless fixing belt 110; a pressure roller 120 that forms a fixing nip part N2 with the fixing belt 110 in contact with the fixing belt 110; a heating member 200 that heats the fixing belt 110; a holding member 300 that holds the heating member 200; and a connector 400 (not shown in FIG. 2) mounted at a predetermined position of the holding member 300.

The fixing belt 110 is configured by laminating an elastic layer formed of silicone rubber, or the like, and a release layer formed of a fluorine-based resin such as PFA or PTFE on the surface of a hollow cylindrical base layer formed of a metal or synthetic resin. The fixing belt 110 is configured to be rotatable.

The pressure roller 120 is a cylindrical member configured by laminating an elastic layer formed of silicone rubber, or the like, and a release layer formed of a fluorine-based resin such as PFA or PTFE on the surface of a cylindrical core formed of a metal. The axial direction of the pressure roller 120 and the axial direction of the fixing belt 110 are parallel.

A shaft 121 extending in the axial direction of the pressure roller 120 is provided at the radial center of the pressure roller 120 as viewed in the axial direction of the pressure roller 120. Both ends of the shaft 121 are rotatably supported by bearings (not shown).

The pressure roller 120 is in contact with the outer peripheral surface of the fixing belt 110 in a biased state. Thus, the fixing nip part N2 is formed between the pressure roller 120 and the fixing belt 110. The pressure roller 120 is rotated by being driven by a drive source (not shown) via a drive mechanism (not shown). When the pressure roller 120 is rotated, the fixing belt 110 is rotated in accordance with the rotation of the pressure roller 120 while being in contact with the pressure roller 120.

[The Heating Member 200]

Figure 3A:
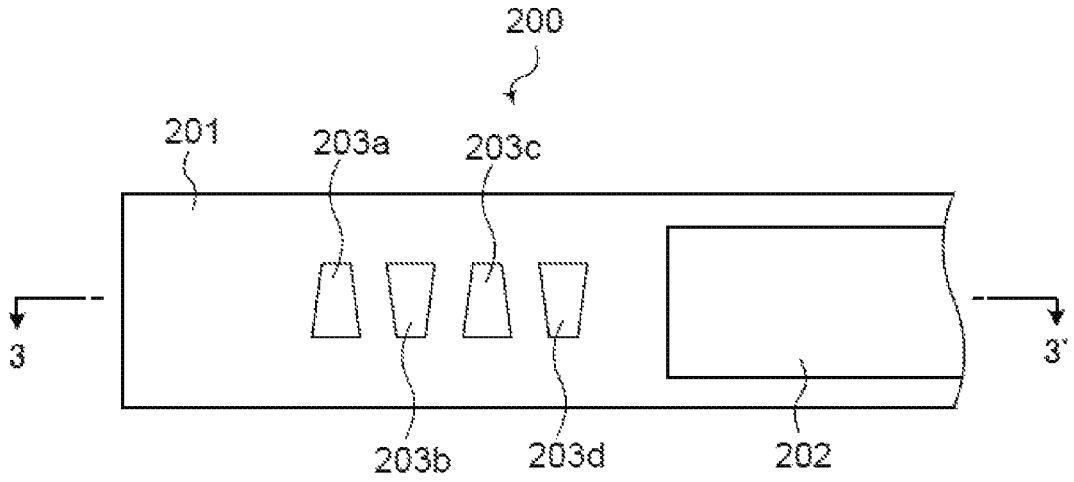
FIG. 3A and FIG. 3B are diagrams each showing a configuration of one end part of a heating member in a longer direction.
Figure 3B:
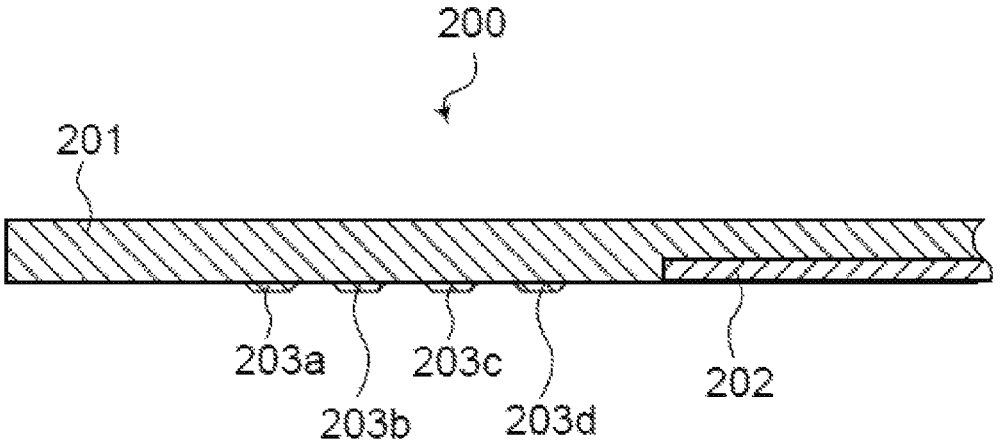

FIG. 3A is a bottom view showing the configuration of one end part of the heating member 200 in the longer direction. FIG. 3B is a cross-sectional view showing the configuration of one end part of the heating member 200 in the longer direction and is a cross-sectional view taken along the line 3-3' shown in FIG. 3A. The configuration of the other end part of the heating member 200 in the longer direction is the same as the configuration of one end part of the heating member 200 in the longer direction.

With reference to FIGS. 3A and 3B, the heating member 200 includes a substrate 201, a heat generating body 202, and electrodes 203*a*, 203*b*, 203*c*, and 203*d* (hereinafter, there is a case of simply referred to as "electrode 203").

The substrate 201 is a substantially cuboidal member. The substrate 201 is formed of a ceramic-based material such as $Al_2O_3$ (alumina), which has electrical insulation.

The heat generating body 202 is a pattern layer formed by atmospheric baking on an electric resistance material such as AgPd (silver-palladium alloy) coated by screen printing, or the like. The heat generating body 202 is formed at the central part of the substrate 201 in the longer direction along the longer direction of the substrate 201. The heat generating body 202 generates heat when it is energized through the electrode 203 and heats the fixing belt 110.

The electrode 203 is a pattern layer formed by atmospheric baking on a conductive metal material such as Ag (silver) and Cu (copper) coated by screen printing, or the like. The electrodes 203*a*, 203*b*, 203*c*, and 203*d* are formed in line in the longer direction of the substrate 201 at both ends of the substrate 201 in the longer direction. The electrode 203 is electrically connected to the heat generating body 202 through a wire (not shown).

The heat generating body 202 and the electrodes 203 are formed on the same surface of the substrate 201. Hereinafter, in the substrate 201, the surface on which the heat generating body 202 and the electrodes 203 are formed is referred to as a first surface of the substrate 201. In the substrate 201, the surface opposite to the first surface is referred to as a second surface of the substrate 201. Further, a direction perpendicular to the longer direction of the substrate 201 is referred to as a shorter direction of the substrate 201. A direction perpendicular to a plane including the longer direction and the shorter direction of the substrate 201 is referred to as a thickness direction of the substrate 201.

As shown in FIG. 3A, the electrodes 203*a*, 203*b*, 203*c*, and 203*d* are formed in an isosceles trapezoid. The electrodes 203*a*, 203*b*, 203*c*, and 203*d* have the same shape. The electrodes 203*a* and 203*c* are formed such that the short side of the trapezoid is located on one end side in the shorter direction of the substrate 201. The electrodes 203*b* and 203*d* are formed such that the short side of the trapezoid is located on the other end side in the shorter direction of the substrate 201.

A protective layer (not shown) is formed on the first surface of the substrate 201 so as to cover the heat generating body 202 in a state where the electrode 203 is exposed. The above-described protective layer is formed of an insulating material such as glass.

A temperature detecting element (not shown) such as a thermistor is provided on the second surface of the substrate 201 at the central part of the substrate 201 in the longer direction. The above-described temperature detecting element detects the temperature of the heating member 200 and inputs the detected information to a control unit (not shown). The control unit controls the supplied power to the electrode 203 based on the input information so that the temperature of the heating member 200 is maintained at a predetermined temperature.

[The Holding Member 300]

Figure 4A:
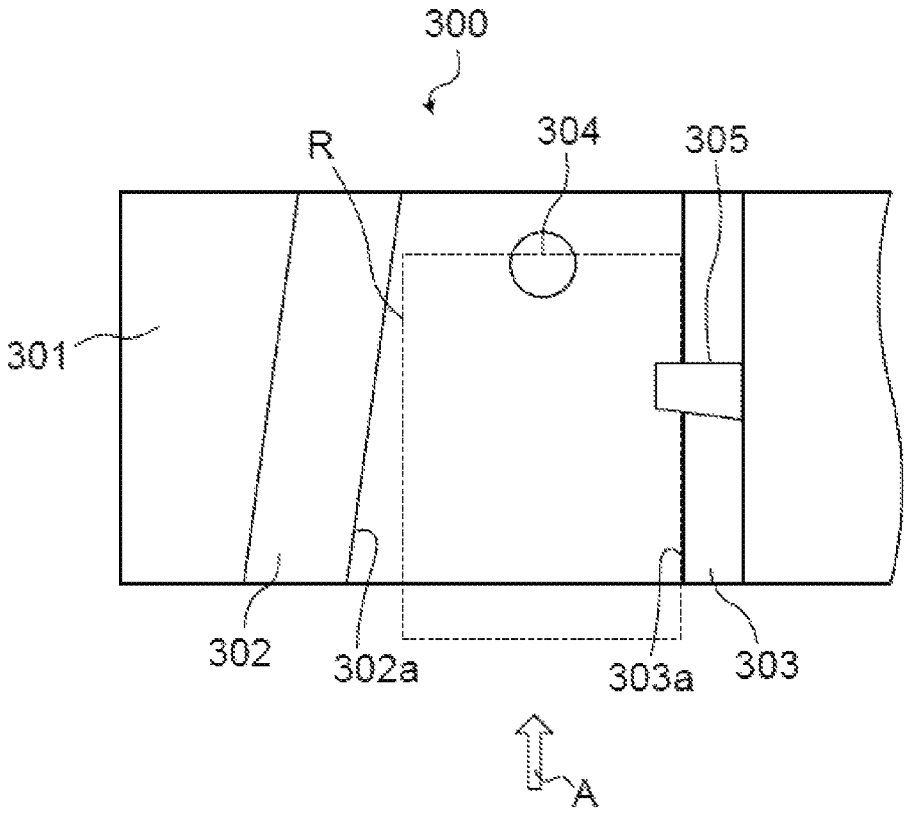
FIG. 4A and FIG. 4B are diagrams each showing a configuration of one end part of a holding member in the longer direction.
Figure 4B:
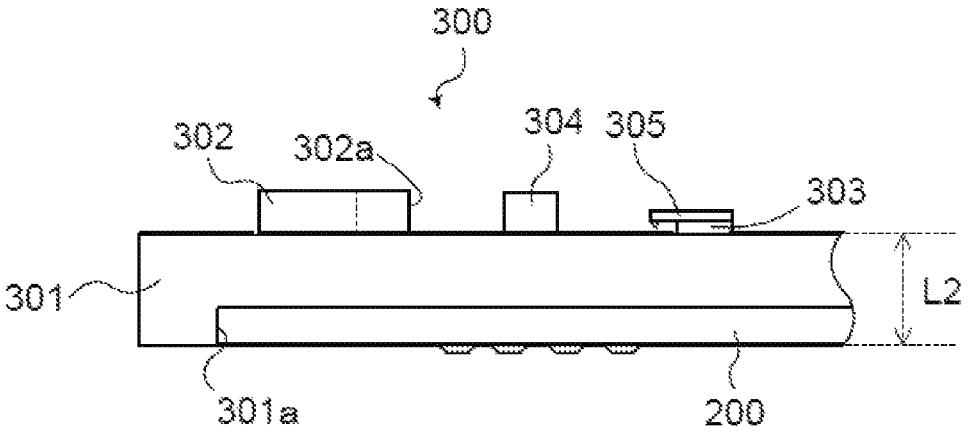

FIG. 4A is a top view showing the configuration of one end part of the holding member 300 in the longer direction. FIG. 4B is a side view showing the configuration of one end part of the holding member 300 in the longer direction and is a diagram viewed in the direction of the arrow A shown in FIG. 4A. The configuration of the other end part of the holding member 300 in the longer direction is the same as the configuration of one end part of the holding member 300 in the longer direction.

With reference to FIGS. 4A and 4B, the holding member 300 includes a holding part 301, a first guide part 302, a second guide part 303, a positioning part 304, and a hook part 305. A connector 400 is mounted at a predetermined position R. The predetermined position R is an area corresponding to the part where the electrode 203 of the heating member 200 is exposed from the fixing belt 110.

The holding part 301 is a substantially cuboidal member. The holding part 301 is formed of a heat-resistant synthetic resin or the like. In the holding part 301, a groove 301*a* is provided for fitting and holding the heating member 200 along the longer direction of the holding part 301. The heating member 200 is fitted into the groove 301*a* such that the longer direction of the substrate 201 is parallel to the longer direction of the holding part 301. The holding part 301 is located inward of the fixing belt 110 in the radial direction as viewed in the axial direction of the fixing belt 110 and is disposed to penetrate the fixing belt 110 in the axial direction of the fixing belt 110 so that the electrodes 203 of the heating member 200 held by the holding part 301 are exposed from the fixing belt 110.

The holding part 301 is biased toward the pressure roller 120 with the fixing belt 110 interposed between the holding part 301 and the pressure roller 120 while holding the heating member 200. Thus, when the pressure roller 120 rotates, the fixing belt 110 slides and rotates in contact with the heating member 200.

Hereinafter, in the holding part 301, the surface on which the groove 301*a* is formed is referred to as a first surface of the holding part 301. In the holding part 301, the surface opposite to the first surface is referred to as a second surface of the holding part 301. Further, the direction perpendicular to the longer direction of the holding part 301 is referred to as the shorter direction of the holding part 301. The direction perpendicular to a plane including the longer direction and the shorter direction of the holding part 301 is referred to as the thickness direction of the holding part 301.

The first guide part 302 is a substantially cuboidal member. The first guide part 302 is formed of a heat-resistant synthetic resin or the like. The first guide part 302 is arranged on the second surface of the holding part 301 such that it is provided with an inclined surface 302*a* which is inclined with respect to the shorter direction of the substrate 201 when viewed in the thickness direction of the substrate 201 of the heating member 200 held by the holding part 301. When the connector 400 is mounted, the first guide part 302 guides the connector 400 so that the connector 400 moves while being in contact with the inclined surface 302*a*.

The second guide part 303 is a cuboidal member. The second guide part 303 is formed of a heat-resistant synthetic resin, or the like. The second guide part 303 is arranged on the second surface of the holding part 301 such that it is provided with a parallel surface 303*a* that is parallel to the shorter direction of the substrate 201 as viewed in the thickness direction of the substrate 201 of the heating member 200 held by the holding part 301. The connector 400 abuts the parallel surface 303*a* when mounted at the predetermined position R.

The positioning part 304 is a cylindrical member. The positioning part 304 is formed of a heat-resistant synthetic resin, or the like. The positioning part 304 is provided on the second surface of the holding part 301 at a position corresponding to the connector 400 mounted at the predetermined position R. The positioning part 304 sets the position of the connector 400 inserted while being in contact with the inclined surface 302*a* so as to be rotatable toward the predetermined position R.

The hook part 305 is a hook-like member having a claw. The hook part 305 is formed of a heat-resistant synthetic resin, or the like. The hook part 305 is disposed at the position corresponding to the connector 400 mounted at the predetermined position R in the second guide part 303.

[The Connector 400]

Figure 5A:
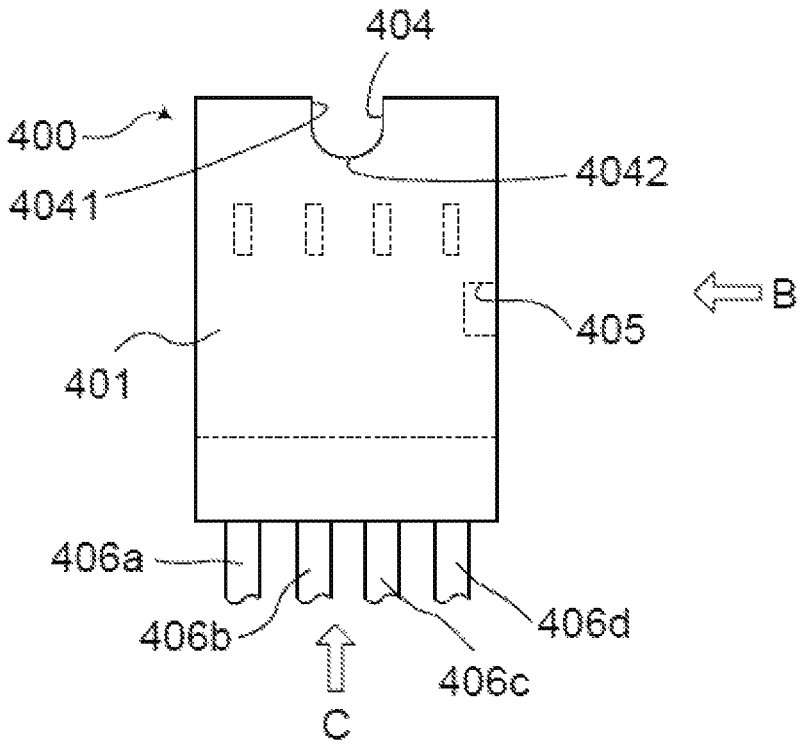
FIGS. 5A, 5B, and 5C are diagrams each showing a configuration of a connector.
Figure 5B:
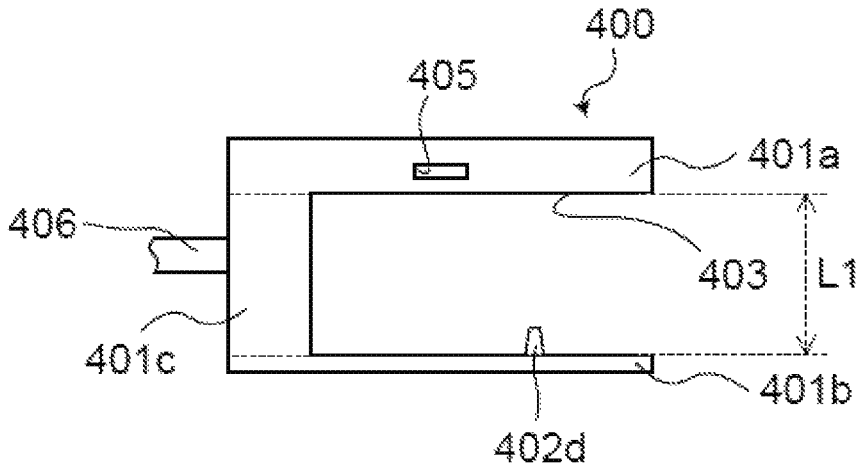
Figure 5C:
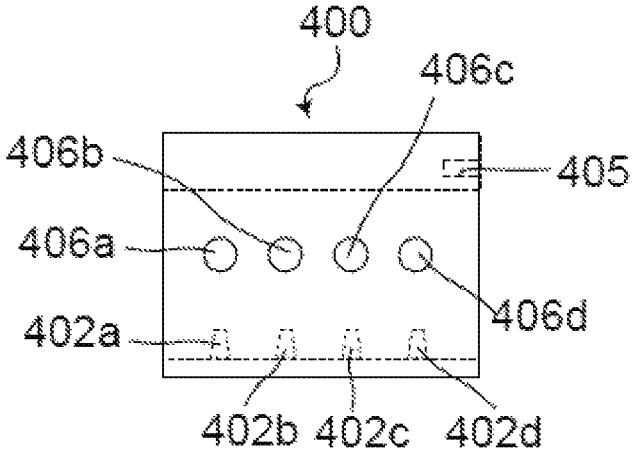

FIG. 5A is a top view showing the configuration of the connector 400. FIG. 5B is a side view showing the configuration of the connector 400 and is a diagram viewed in the direction of the arrow B shown in FIG. 5A. FIG. 5C is a side view showing the configuration of the connector 400 and is a diagram viewed in the direction of the arrow C shown in FIG. 5A. Although the connector 400 mounted on one end part of the holding member 300 in the longer direction is explained below, the connector 400 is similarly mounted on the other end part of the holding member 300 in the longer direction. With reference to FIGS. 5A to 5C, the connector 400 includes a housing 401 and contact terminals 402*a*, 402*b*, 402*c*, and 402*d* (hereinafter, there is a case of simply referred to as "contact terminals 402").

The housing 401 is formed of an insulating synthetic resin, or the like. The housing 401 includes a first part 401*a*, a second part 401*b*, and a third part 401*c*, each formed in a substantially cuboid.

The first part 401*a* and the second part 401*b* are arranged such that opposing surfaces are parallel with a predetermined gap interposed therebetween. The third part 401*c* is arranged to connect one end parts, in the longer direction, of the first part 401*a* and the second part 401*b*. The housing 401 is integrally formed into a substantially U shape in which a groove 403 having a predetermined interval L1 is formed as a whole by the first part 401*a*, the second part 401*b*, and the third part 401*c*. The predetermined interval L1 in the groove 403 is set to be larger than a thickness L2 of the holding part 301 shown in FIG. 4B.

The connector 400 is detachably attached to the holding member 300 by inserting the holding part 301 in a state of holding the heating member 200 into the groove 403 at the predetermined position R of the holding member 300.

At the other end part of the first part 401*a* in the longer direction and at the position corresponding to the positioning part 304 of the holding member 300, a groove part 404 is formed, which has a size so as to have the positioning part 304 fitted thereinto. The positioning part 304 is configured to fit into the groove part 404 in a state where the connector 400 is rotatable around the positioning part 304. The groove part 404 of the connector 400 includes a receiving part 4041 and a restricting part 4042. The receiving part 4041 linearly extends in a receiving direction so as to receive the fitted positioning part 304. The restricting part 4042 is formed in a shape that conforms to the arc formed by the outer shape of the cylindrical positioning part 304 at the end of the receiving part 4041. The restricting part 4042 restricts the movement of the positioning part 304 when the positioning part 304 moves along the linear shape of the receiving part 4041 in the receiving part 4041.

Hereinafter, the direction perpendicular to the longer direction of the first part 401*a* is referred to as the shorter direction of the first part 401*a*. The direction perpendicular to the longer direction of the second part 401*b* is referred to as the shorter direction of the second part 401*b*.

An opening 405 configured to be engaged with the claw of the hook part 305 is provided on the side surface on one end side in the shorter direction of the first part 401*a* and at the position corresponding to the hook part 305 of the holding member 300. Accordingly, when the connector 400 is mounted at the predetermined position R of the holding member 300, the claw of the hook part 305 is engaged with the opening 405.

The contact terminal 402 is a substantially cylindrical terminal formed of a conductive metal such as stainless steel or titanium alloy. The contact terminals 402*a*, 402*b*, 402*c*, 402*d* are provided at the positions corresponding to the electrodes 203*a*, 203*b*, 203*c*, 203*d* of the heating member 200 on the surface of the second part 401*b* opposing to the first part 401*a* and are arranged in line along the shorter direction of the second part 401*b*.

In the space provided inside the housing 401, the contact terminals 402 are electrically connected to four wires 406*a*, 406*b*, 406*c*, 406*d* (hereinafter, there is a case of simply referred to as "wire 406") provided in accordance with the number of the contact terminals 402.

The contact terminal 402 is brought into contact with the electrode 203 of the heating member 200 when the connector 400 is mounted at the predetermined position R of the holding member 300. When the power is supplied from the power supply (not shown) via the wire 406 to the contact terminal 402, the contact terminal 402 applies the electricity to the electrode 203 of the heating member 200.

[Technique of Mounting the Connector 400]

Figure 6A:
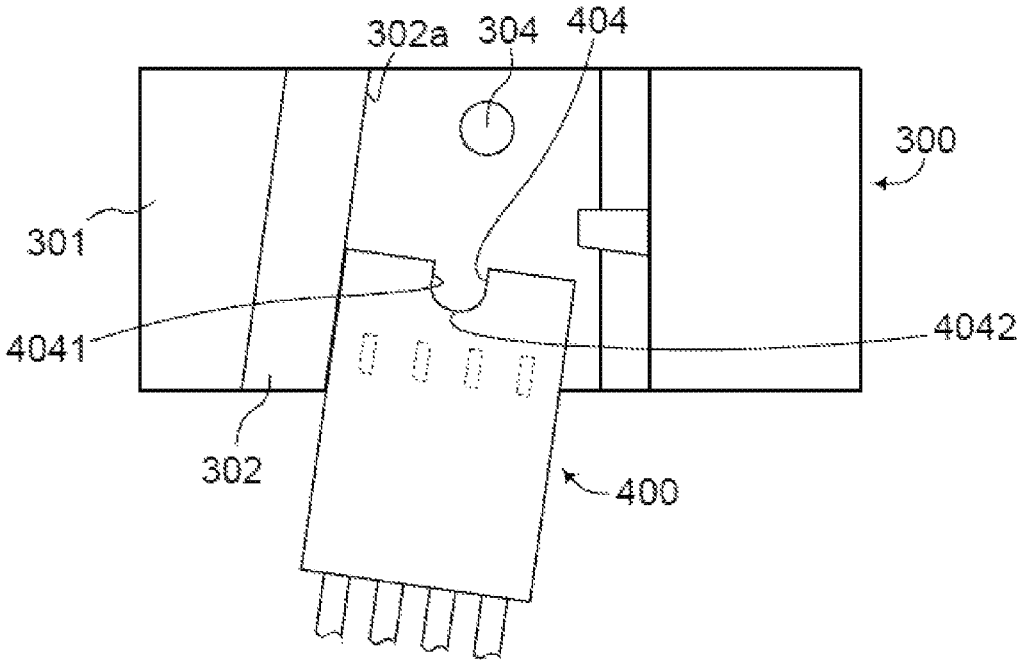
FIGS. 6A, 6B and 6C are diagrams each for explaining a method of mounting the connector.
Figure 6B:
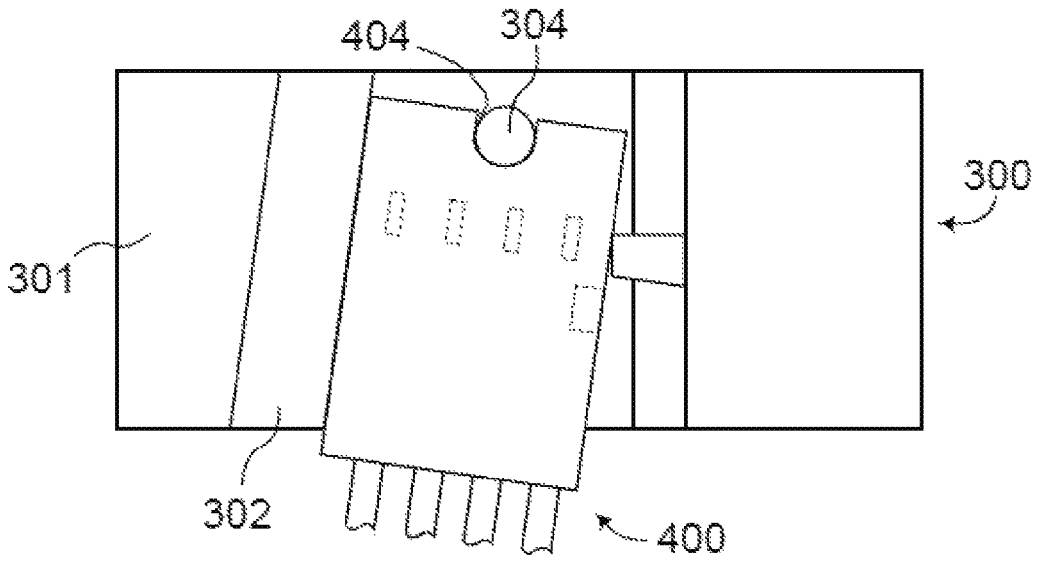
Figure 6C:
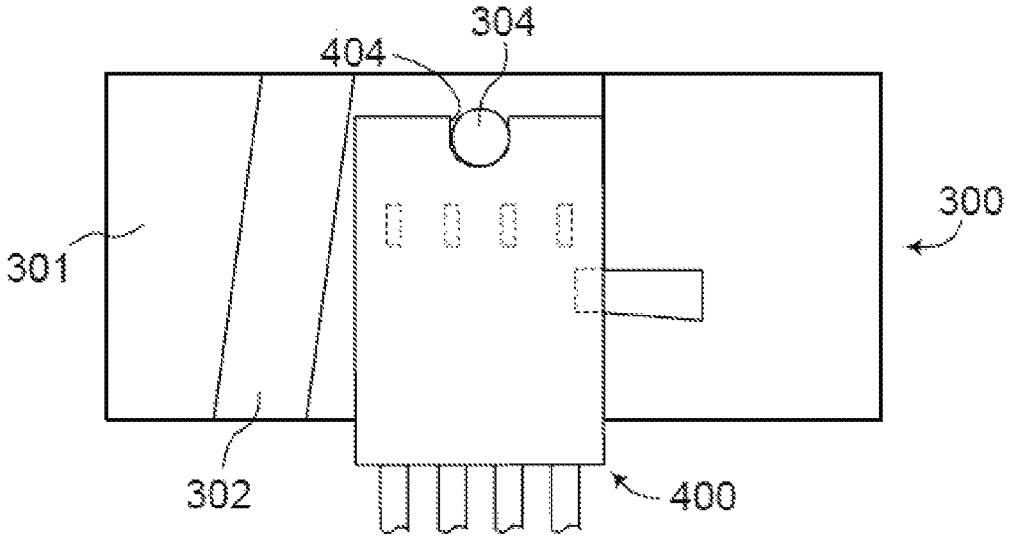

Hereinafter, the technique of mounting the connector 400 is described in order. FIGS. 6A to 6C are diagrams that explain the technique of mounting the connector 400.

With reference to FIG. 6A, the user first inserts the connector 400 along the inclined surface 302*a* of the first guide part 302 in a direction inclined with respect to the shorter direction of the substrate 201 when viewed in the thickness direction of the substrate 201 of the heating member 200. The user moves the connector 400 forward while bringing the connector 400 into contact with the inclined surface 302*a* until the positioning part 304 is fitted into the groove part 404.

With reference to 6B, the user rotates the connector 400 around the positioning part 304 toward the predetermined position R of the holding member 300 in a state where the positioning part 304 is fitted in groove part 404.

Figure 7:
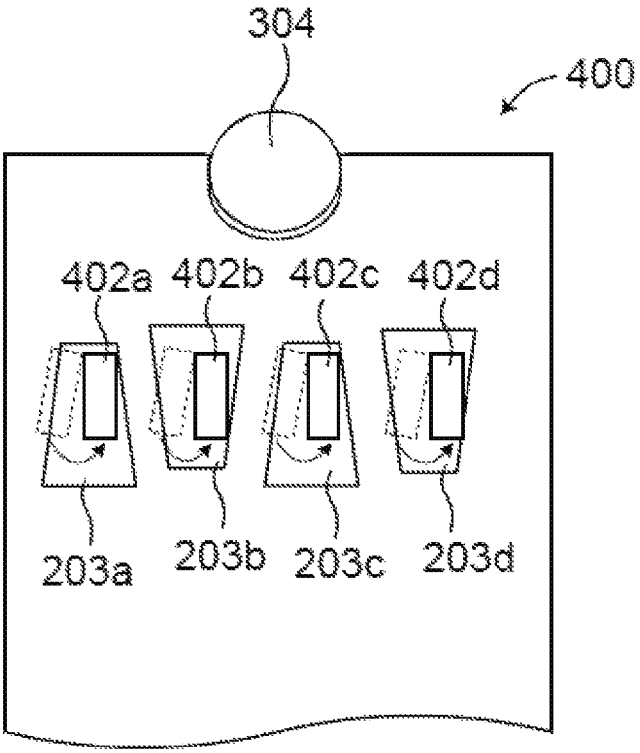
FIG. 7 is a view for explaining positional relationship between an electrode and a contact terminal when the connector is rotated.

FIG. 7 is a diagram that explains the positional relationship between the electrode 203 and the contact terminal 402 when the connector 400 rotates. With reference to FIG. 7, the electrode 203 is formed in the above-described isosceles trapezoid so that the contact terminal 402 is brought into contact with the electrode 203 over a period before and after the rotation of the connector 400. Therefore, while the connector 400 is rotated, the contact terminals 402*a*, 402*b*, 402*c*, 402*d* are rotated in accordance with the rotation of the connector 400 while they are in contact with the electrodes 203*a*, 203*b*, 203*c*, 203*d*.

With reference to FIG. 6C, when the connector 400 comes to the predetermined position R of the holding member 300, the connector 400 abuts the parallel surface 303*a*, and the claw of the hook part 305 of the holding part 301 is engaged with the opening 405 of the connector 400. That is, the connector 400 is rotated along the arc formed by the outer shape of the positioning part 304 in a state where the positioning part 304 of the holding member 300 is fitted into the receiving part 4041 of the groove part 404 and the positioning part 304 is in contact with the restricting part 4042. Then, the hook part 305 engages with the opening 405, thereby the rotation of the connector 400 is stopped, and the connector 400 is fixed to the holding member 300.

Figure 8:
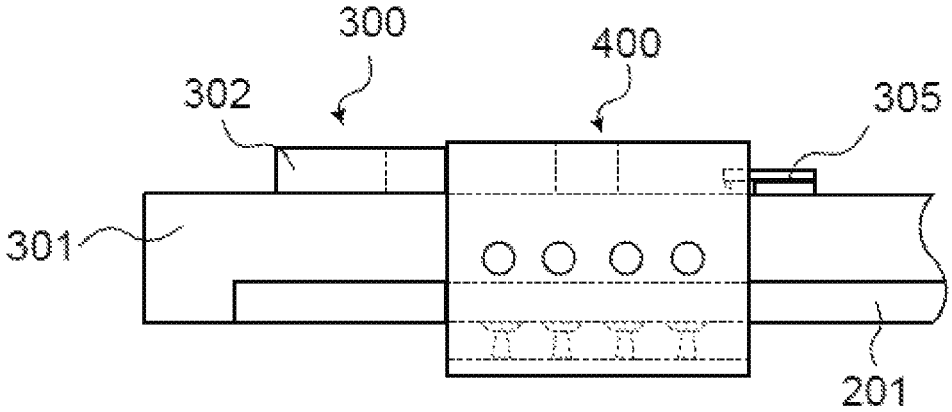
FIG. 8 is a side view showing a state in which the connector is attached.

FIG. 8 is a side view showing a state in which the connector 400 is attached. With reference to FIG. 8, the connector 400 is attached to the holding member 300 by inserting the holding part 301 in a state of holding the heating member 200 into the groove 403 at the predetermined position R of the holding member 300.

[Operation of the Fixing Device 100]

The operation of the fixing device 100 is described below. In the following description, the two connectors 400 are attached to both ends of the holding member 300 in the longer direction.

The pressure roller 120 is in contact with the outer peripheral surface of the fixing belt 110 in a pressurized state. When the pressure roller 120 is driven and rotated by a drive source (not shown) via a drive mechanism (not shown), the fixing belt 110 is driven to rotate in the opposite direction to the pressure roller 120.

Electric power is supplied from the power supply (not shown) to the contact terminal 402 through the wire 406, and when current is supplied from the contact terminal 402 to the electrode 203, the heat generating body 202 generates heat.

The holding part 301 in a state of holding the heating member 200 is biased toward the pressure roller 120 with the fixing belt 110 interposed between the holding part 301 and the pressure roller 120. As a result, the fixing belt 110 is rotatably slid and heated while being in contact with the heating member 200.

In this state, when the recording paper P carrying the unfixed color toner image formed by the image forming unit 5 is conveyed to the fixing nip part N2, the recording paper P is heated and pressed in the fixing nip part N2 so that the toner image is fixed to the recording paper P.

According to the above embodiment, in the fixing device 100, the holding member 300 includes: the first guide part 302 having the inclined surface 302*a* inclined with respect to the predetermined direction; and the positioning part 304 that sets the position of the inserted connector 400 in a rotatable state to the predetermined position while being in contact with the inclined surface 302*a*. Further, the electrode 203 is configured such that the contact terminal 402 is brought into contact with the electrode 203 over a period before and after the rotation of the connector 400.

Thus, the connector 400 is inserted in a direction inclined with respect to a predetermined direction while being in contact with the inclined surface 302*a*, and it is then rotated in a state where the contact terminal 402 is in contact with the electrode 203, whereby it is mounted at the predetermined position. Therefore, as compared with the case where the connector 400 is directly inserted and mounted in the shorter direction of the heating member 200, the distance at which the contact terminal 402 is in contact with the electrode 203 may be longer; thus, contact failures between the electrode 203 and the contact terminal 402 may be avoided without increasing the size of the connector 400.

Further, according to the above-described embodiment, the holding member 300 includes the hook part 305 having the claw, and the connector 400 includes the opening 405 with which the claw of the hook part 305 is engaged when the connector 400 is mounted at the predetermined position R of the holding member 300. Therefore, the connector 400 is fixed by the engagement of the claw of the hook part 305 with the opening 405; thus, as compared with the case where a member such as a lock member for fixing the connector 400 is provided in the connector 400, the size of the connector 400 may be reduced, and the cost needed to produce the connector 400 may be reduced as the connector 400 is formed with less resin material.

Further, according to the above embodiment, the connector 400 includes the groove part 404 configured to have the positioning part 304 fitted thereinto, and the positioning part 304 is configured to be fitted into the groove part 404 in such a state that the connector 400 is rotatable around the positioning part 304. This allows efficient positioning and rotation of the connector 400 without increasing the number of members.

Further, according to the above embodiment, the heating member 200 includes the substrate 201 on which the electrode 203 is formed, and the predetermined direction is a direction inclined with respect to the shorter direction of the substrate 201 when viewed in the thickness direction of the substrate 201. Thus, as compared with the case where the connector 400 is directly inserted and mounted in the shorter direction of the heating member 200, it may be ensured that the distance at which the contact terminal 402 is in contact with the electrode 203 is longer.

Further, according to the above embodiment, as the image forming apparatus 1 includes the above-described fixing device 100, contact failures between the electrode and the contact terminal may be avoided without increasing the size of the connector, and smooth image formation may be performed. According to the above embodiment, the electrode 203 is formed in the shape of an isosceles trapezoid; however, the shape of the electrode 203 is not particularly limited as long as it has a shape configured such that the contact terminal 402 is in contact with the electrode 203 over a period before and after the rotation of the connector 400.

In typical connectors other than the connector 400 according to the present embodiment, in order to avoid contact failures between the electrode and the contact terminal, it is necessary to increase the contact distance between the electrode and the contact terminal when the connector is attached; thus, the connector tends to be large. In addition, when the connector is provided with a member such as a lock member, the size of the connector may be further larger. However, in the fixing device 100 according to the present embodiment, contact failures between the electrode and the contact terminal may be avoided without increasing the size of the connector 400.

(First Modification)

Figure 9:
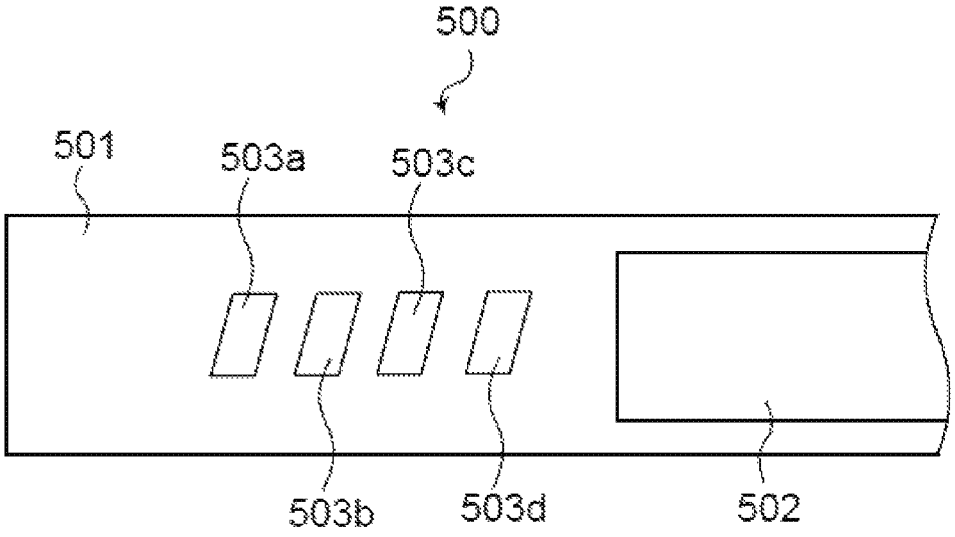
FIG. 9 is a bottom view showing a configuration of one end part of the heating member in the longer direction according to a first modification.

FIG. 9 is a bottom view showing the configuration of one end part of the heating member 500 in the longer direction according to a first modification. With reference to FIG. 9, a heating member 500 includes a substrate 501, a heat generating body 502, and electrodes 503*a*, 503*b*, 503*c*, 503*d* (hereinafter, there is a case of simply referred to as "electrode 503"). According to the first modification, the heating member 500 has the same configuration as that of the heating member 200 in the above embodiment except that the shape of the electrode 503 is different. Hereinafter, only different configurations are described.

The electrodes 503*a*, 503*b*, 503*c*, 503*d* are formed in the shape of a parallelogram. The electrodes 503*a*, 503*b*, 503*c*, 503*d* have the same shape. The electrodes 503*a*, 503*b*, 503*c*, 503*d* are formed in line along the longer direction of the substrate 501 such that the direction of the pair of opposite sides of the parallelogram is parallel to the inclination direction of the inclined surface 302*a*. Thus, while the connector 400 is rotated, the contact terminals 402*a*, 402*b*, 402*c*, 402*d* are rotated in accordance with the rotation of the connector 400 while they are in contact with the electrodes 503*a*, 503*b*, 503*c*, 503*d*, respectively.

(Second Modification)

Figure 10:
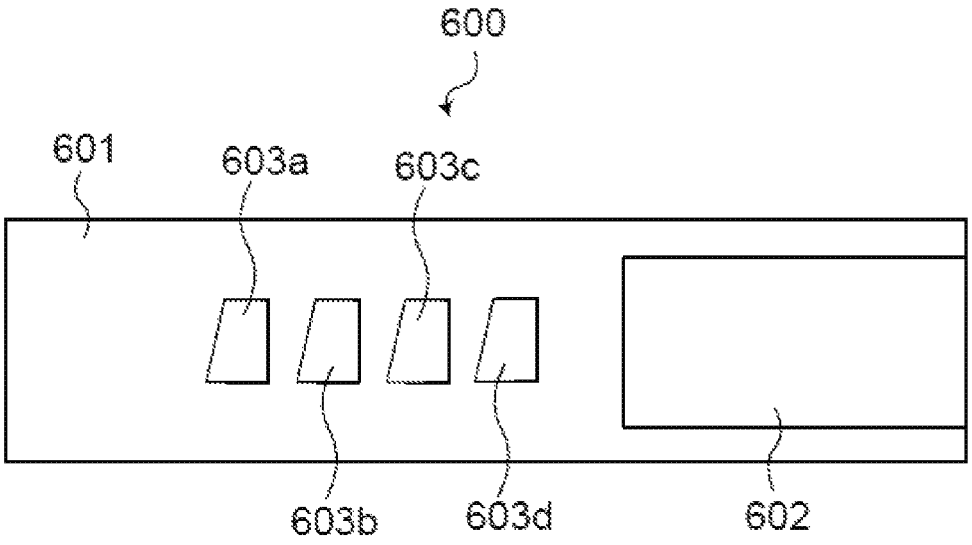
FIG. 10 is a bottom view showing a configuration of one end part of the heating member in the longer direction according to a second modification.

FIG. 10 is a bottom view showing the configuration of one end part of the heating member 600 in the longer direction according to a second modification. With reference to FIG. 10, a heating member 600 includes a substrate 601, a heat generating body 602, and electrodes 603*a*, 603*b*, 603*c*, 603*d* (hereinafter, there is a case of simply referred to as "electrode 603"). According to the second modification, the heating member 600 has the same configuration as that of the heating member 200 in the above embodiment except that the shape of the electrode 603 is different. Hereinafter, only different configurations are described.

The electrodes 603*a*, 603*b*, 603*c*, 603*d* are formed in the shape of a trapezoidal. The electrodes 603*a*, 603*b*, 603*c*, 603*d* have the same shape. In the electrodes 603*a*, 603*b*, 603*c*, 603*d*, one of the two sides connecting the upper and lower bases of the trapezoid is formed to be perpendicular to the upper and lower bases. The other side is formed to be inclined with respect to the upper and lower bases. The electrodes 603*a*, 603*b*, 603*c*, 603*d* are formed in line along the longer direction of the substrate 601 such that the direction of the other side of the trapezoid is parallel to the inclination direction of the inclined surface 302*a*. Thus, while the connector 400 is rotated, the contact terminals 402*a*, 402*b*, 402*c*, 402*d* are rotated in accordance with the rotation of the connector 400 while they are in contact with the electrodes 603*a*, 603*b*, 603*c*, 603*d*.

(Other Modifications)

The present disclosure is not limited to the configuration according to the above embodiment, and various modifications are possible.

For example, although four electrodes are provided as the electrodes 203, 503, 603 according to the above embodiments, the present disclosure is not limited to the embodiments, and for example, the number of electrodes may be one or two.

Further, in the above embodiment, the configurations and processes shown in the above embodiment using FIGS. 1 to 10 are merely an embodiment of the present disclosure, and there is no intention to limit the present disclosure to the configurations and the processes.

Various modifications and changes to the present disclosure may be apparent to those skilled in the art without departing from the scope and spirit of the present disclosure. It should also be understood that the present disclosure is not limited to the exemplary embodiments described in this description.

What is claimed is:

1. A fixing device comprising:

a fixing belt that is endless;

a pressure roller that is in contact with the fixing belt to form a fixing nip part with the fixing belt;

a heating member that includes an electrode and heats the fixing belt when the electrode is energized;

a holding member that holds the heating member; and a connector that includes a contact terminal in contact with the electrode and is mounted at a predetermined position of the holding member so that the electrode and the contact terminal are in contact with each other, wherein the holding member includes:

a guide part having an inclined surface that is inclined with respect to a predetermined direction; and a positioning part that sets a position of the connector, inserted while being in contact with the inclined surface, in a rotatable state toward the predetermined position, and the electrode is configured such that the contact terminal is in contact with the electrode over a period before and after rotation of the connector.

2. The fixing device according to claim 1, wherein the holding member further includes a hook part having a claw, and on the connector, an opening, with which the claw of the hook part is engaged when the connector is mounted at the predetermined position, is further formed.

3. The fixing device according to claim 1, wherein the connector further includes a groove part configured to have the positioning part fitted thereto, and the positioning part is configured to be fitted into the groove part in a state where the connector is rotatable around the positioning part.

4. The fixing device according to claim 3, wherein the holding member further includes a hook part having a claw, on the connector, an opening, with which the claw of the hook part is engaged when the connector is mounted at the predetermined position, is further formed, the positioning part of the holding member is a cylindrical member, the groove part of the connector includes:

a receiving part that linearly extends in a receiving direction to receive the positioning part fitted into the groove; and a restricting part that is formed at an end of the receiving part in a shape that conforms to an arc formed by an outer shape of the cylindrical positioning part and that restricts a movement of the positioning part within the receiving part, and in a state where the positioning part of the holding member is fitted into the receiving part of the groove part and the positioning part abuts the restricting part, the connector is rotated along the arc formed by the outer shape of the positioning part and the hook part engages with the opening, thereby the rotation of the connector is stopped, and the connector is fixed to the holding member.

5. The fixing device according to claim 1, wherein the heating member includes a substrate on which the electrode is formed, and the predetermined direction is a direction inclined with respect to a shorter direction of the substrate when viewed in a thickness direction of the substrate.

6. An image forming apparatus comprising:

the fixing device according to claim 1; and an image forming unit that forms a toner image on a recording sheet, wherein the fixing device fixes the toner image formed by the image forming unit to the recording sheet at the fixing nip part.

* * * * *